US010504444B2

(12) United States Patent
Cheng

(10) Patent No.: US 10,504,444 B2
(45) Date of Patent: Dec. 10, 2019

(54) PIXEL CIRCUIT

(71) Applicant: Au Optronics Corporation, Hsinchu (TW)

(72) Inventor: Mao-Hsun Cheng, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 16/028,430

(22) Filed: Jul. 6, 2018

(65) Prior Publication Data

US 2019/0279570 A1 Sep. 12, 2019

(30) Foreign Application Priority Data

Mar. 9, 2018 (TW) ..... 107108159 A

(51) Int. Cl.

| | |
|---|---|
| ***G09G 3/36*** | (2006.01) |
| ***G09G 3/30*** | (2006.01) |
| ***G09G 3/3258*** | (2016.01) |
| ***G09G 3/32*** | (2016.01) |

(52) U.S. Cl.

CPC ..... *G09G 3/3258* (2013.01); *G09G 3/32* (2013.01); *G09G 2300/0819* (2013.01); *G09G 2320/045* (2013.01)

(58) Field of Classification Search

CPC ... G09G 3/36; G09G 5/00; G09G 3/30; G11C 19/00; G02F 1/1345; G06F 3/038

See application file for complete search history.

(56) References Cited

U.S. PATENT DOCUMENTS

| | | | | |
|---|---|---|---|---|
| 8,654,041 | B2 | 2/2014 | Kang et al. | |
| 9,214,506 | B2 * | 12/2015 | Xie | H01L 27/3265 |
| 9,647,047 | B2 | 5/2017 | Jeong et al. | |
| 9,691,328 | B2 | 6/2017 | Qing et al. | |
| 2008/0036710 | A1 | 2/2008 | Kim | |
| 2010/0127956 | A1 | 5/2010 | Kang et al. | |
| 2014/0159609 | A1 | 6/2014 | Xie | |
| 2014/0347347 | A1 | 11/2014 | Jeong et al. | |
| 2016/0232836 | A1 * | 8/2016 | Yang | G09G 3/3233 |

(Continued)

FOREIGN PATENT DOCUMENTS

| | | |
|---|---|---|
| CN | 101123070 | 2/2008 |
| CN | 101739947 | 6/2010 |

(Continued)

*Primary Examiner* — Pegeman Karimi
(74) *Attorney, Agent, or Firm* — JCIPRNET

(57) ABSTRACT

A pixel circuit is provided. The pixel circuit includes a light emitting element, first to third transistors, first to second capacitors and a voltage setting circuit. The light emitting element receives a system low voltage. The first transistor receives a system high voltage and controlled by an emission signal. The second transistor is coupled between the first transistor and the light emitting device. The first capacitor is coupled to the second transistor. The second capacitor is coupled between the first capacitor and the first transistor. The voltage setting circuit receives first to second scan signals, a source driving signal and a data voltage to remove charges stored in the first capacitor according to the first to second scan signal, and writes the data voltage to the first capacitor according to the source driving signal. The third transistor is controlled by the second scan signal and receives a first reference voltage.

12 Claims, 3 Drawing Sheets

(56) References Cited

U.S. PATENT DOCUMENTS

| | | | | |
|---|---|---|---|---|
| 2016/0351126 | A1* | 12/2016 | Qing | G09G 3/3258 |
| 2018/0108295 | A1* | 4/2018 | Ebisuno | G09G 3/3233 |
| 2018/0197462 | A1* | 7/2018 | Nagayama | G09G 3/32 |
| 2019/0130839 | A1* | 5/2019 | Sun | G09G 3/3266 |

FOREIGN PATENT DOCUMENTS

| | | |
|---|---|---|
| CN | 102982767 | 3/2013 |
| CN | 104409043 | 3/2015 |
| TW | 201503087 | 1/2015 |
| TW | I527012 | 3/2016 |

* cited by examiner

PIXEL CIRCUIT

CROSS-REFERENCE TO RELATED APPLICATION

This application claims the priority benefit of Taiwan application serial no. 107108159, filed on Mar. 9, 2018. The entirety of the above-mentioned patent application is hereby incorporated by reference herein and made a part of this specification.

BACKGROUND OF THE INVENTION

Field of the Invention

The invention relates to a display device, and particularly relates to a pixel circuit.

Description of Related Art

Along with development of technology, display device has become an indispensable tool in people's daily life. In order to provide a good human-machine interface, a high-quality display panel has become a necessary device in the display device.

In the display device, a display image presented by the display panel is easy to be influenced by a threshold voltage of a driving transistor in a pixel circuit, which leads to quality decrease of the display image. Therefore, the display device may compensate the threshold voltage of the driving transistor, so as to further decrease the influence of the threshold voltage on the display image.

On the other hand, in a high-resolution display panel, a time length for the pixel circuit executing a data writing operation is shortened. Namely, a time length for the pixel circuit compensating the threshold voltage is shortened, such that a compensation effect on the threshold voltage performed by the pixel circuit is affected. Therefore, how to mitigate the influence of the threshold voltage on the quality of the display image is an important issue for related technicians of the field.

SUMMARY OF THE INVENTION

The invention is directed to a pixel circuit, which is adapted to dividedly operate in a voltage compensation period and a data writing period of a frame period, such that a compensation time length of a threshold voltage is adapted to be adjusted, and the compensation time length is not influenced by a data writing time length, by which quality of a display image presented by a display penal is ameliorated.

The invention provides a pixel circuit including a light emitting element, a first to a third transistors, a first to a second capacitors and a voltage setting circuit. The light emitting element has an anode and a cathode receiving a system low voltage. The first transistor has a first terminal receiving a system high voltage, a control terminal receiving an emission signal and a second terminal. The second transistor has a first terminal coupled to the first transistor, a control terminal and a second terminal coupled to the light emitting element. The first capacitor has a first end and a second end coupled to the second transistor. The second capacitor has a first end coupled to the first capacitor and a second end coupled to the first transistor. The voltage setting circuit is coupled to the first end and the second end of the first capacitor, and receives a first to a second scan signals, a source driving signal and a data voltage to remove charges stored in the first capacitor according to the first scan signal and the second scan signal, and writes the data voltage to the first capacitor according to the source driving signal. The third transistor has a first terminal coupled to the second transistor, a control terminal coupled to the second scan signal and a second terminal receiving a first reference voltage.

According to the above description, the voltage setting circuit in the pixel circuit of the present embodiment is adapted to remove charges stored in the first capacitor according to the first scan signal and the second scan signal, and write the data voltage to the first capacitor according to the source driving signal. In this way, a time length for the pixel circuit compensating the threshold voltage is not influenced by a time length for writing data to the first capacitor, so as to improve the quality of the display image presented by the display panel.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
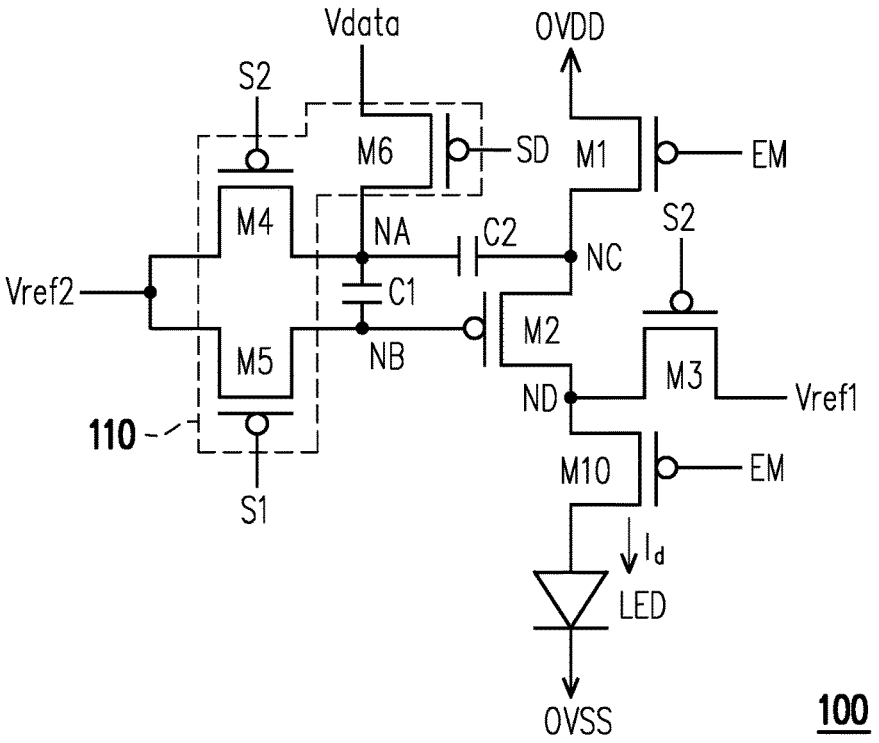
FIG. 1 is a circuit diagram of a pixel circuit according to an embodiment of the invention.

FIG. 1 is a circuit diagram of a pixel circuit according to an embodiment of the invention. Referring to FIG. 1, in the present embodiment, the pixel circuit 100 includes a light emitting element LED, a first to a third transistors M1-M3, a tenth transistor M10, a first to a second capacitors C1-C2 and a voltage setting circuit 110. The voltage setting circuit 110 is coupled to a first end and a second end of the first capacitor C1 and a first end of the second capacitor C2, and the voltage setting circuit 110 may receive a first scan signal S1, a second scan signal S2, a source driving signal SD and a data voltage Vdata. Moreover, the voltage setting circuit 110 may include a fourth to a sixth transistors M4-M6, and the first to the sixth transistors M1-M6 and the tenth transistor M10 are, for example, P-type transistors, though the invention is not limited thereto.

In the present embodiment, the light emitting element LED has an anode and a cathode receiving a system low voltage OVSS. The light emitting element LED of the present embodiment may be one of an organic light emitting diode and a micro light emitting diode, though the invention is not limited thereto. On the other hand, a source (corresponding to a first terminal) of the first transistor M1 is coupled to a system high voltage OVDD, a gate (corresponding to a control terminal) of the first transistor M1 receives an emission signal EM, and a drain (corresponding to a second terminal) of the first transistor M1 is coupled to a second end of the second capacitor C2. A source (corresponding to a first terminal) of the second transistor M2 is coupled to the drain of the first transistor M1, a gate (corresponding to a control terminal) of the second transistor M2 is coupled to the second end of the first capacitor C1. A source (corresponding to a first terminal) of the third transistor M3 is coupled to a drain (corresponding to a second terminal) of the second transistor M2, a gate (corresponding to a control terminal) of the third transistor M3 receives the second scan signal S2, and a drain (corresponding to a second terminal) of the third transistor M3 receives a first reference voltage Vref1. A source (corresponding to a first terminal) of the tenth transistor M10 is coupled to the drain of the second transistor M2, a gate (corresponding to a control terminal) of the tenth transistor M10 receives the emission signal EM, and a drain (corresponding to a second terminal) of the tenth transistor M10 is coupled to the anode of the light emitting element LED.

On the other hand, in the voltage setting circuit 110 of the present embodiment, a source (corresponding to a first terminal) of the fourth transistor M4 receives a second reference voltage Vref2, a gate (corresponding to a control terminal) of the fourth transistor M4 receives the second scan signal S2, and a drain (corresponding to a second terminal) of the fourth transistor M4 is coupled to the first end of the first capacitor C1. A source (corresponding to a first terminal) of the fifth transistor M5 receives the second reference voltage Vref2, a gate (corresponding to a control terminal) of the fifth transistor M5 receives the first scan signal S1, and a drain (corresponding to a second terminal) of the fifth transistor M5 is coupled to the second end of the first capacitor C1. A source (corresponding to a first terminal) of the sixth transistor M6 receives the data voltage Vdata, a gate (corresponding to a control terminal) of the sixth transistor M6 receives the source driving signal SD, and a drain (corresponding to a second terminal) of the sixth transistor M6 is coupled to the first end of the first capacitor C1 and the first end of the second capacitor C2. In the present embodiment, the second reference voltage Vref2 may be greater than the first reference voltage Vref1, and the first reference voltage Vref1 may be smaller than a sum of the system low voltage OVSS and a lighting threshold voltage of the light emitting element LED, though the invention is not limited thereto.

It should be noted that in the present embodiment, the voltage setting circuit 110 may remove charges stored in the first capacitor C1 according to the first scan signal S1 and the second scan signal S2, and the voltage setting circuit 110 may write the data voltage Vdata to the first capacitor C1 according to the source driving signal SD. In other words, the voltage setting circuit 110 may perform actions related to reset and data writing to the first capacitor C1 according to the first scan signal S1, the second scan signal S2 and the source driving signal SD.

It should be noted that in the present embodiment of the invention, the first scan signal S1 and the second scan signal S2 may be transmitted by one of a plurality of gate lines in a display panel (not shown). Moreover, the data voltage Vdata may be transmitted by one of a plurality of data lines in the display panel (not shown). Moreover, a plurality of pixels in the display panel (not shown) are arranged in a matrix, and are configured at intersections of the data lines and the gate lines, such that circuit operation of the pixel circuit (for example, the pixel circuit 100) is controlled through the corresponding gate line and data line.

Figure 2:
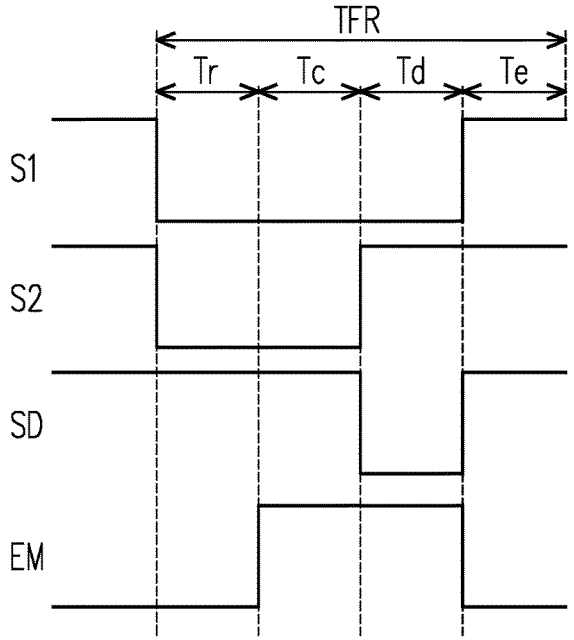
FIG. 2 is a waveform diagram of a pixel circuit according to an embodiment of the invention.

FIG. 2 is a waveform diagram of the pixel circuit according to an embodiment of the invention. Referring to FIG. 2, in the present embodiment, one frame period TFR of the pixel circuit 100 may be divided into a voltage reset period Tr, a voltage compensation period Tc, a data writing period Td and a emission period Te, and the voltage reset period Tr, the voltage compensation period Tc, the data writing period Td and the emission period Tc are not overlapped with each other. The voltage compensation period Tc is located behind the voltage reset period Tr, the data writing period Td is located behind the voltage compensation period Tc, and the emission period Te is located behind the data writing period Td. For example, in the frame period TFR, the voltage reset period Tr and the voltage compensation period Tc of the pixel circuit 100 may be regarded as a setting time of the pixel circuit 100; the data writing period Td of the pixel circuit 100 may be regarded as a data writing time of the pixel circuit 100; and the emission period Te of the pixel circuit 100 may be regarded as a display time of the pixel circuit 100.

Referring to FIG. 1 and FIG. 2, in detail, when the pixel circuit 100 is operated in the voltage reset period Tr, the first scan signal S1, the second scan signal S2 and the emission signal EM may be enabled (for example, to have a low voltage level), such that the first to the fifth transistors M1-M5 and the tenth transistor M10 may be turned on, and the source driving signal SD may be disabled (for example, to have a high voltage level), such that the sixth transistor M6 may be turned off, and the data voltage Vdata cannot be transmitted to the pixel circuit 100. In this case, voltage values on the first end (i.e. a node NA) and a second end (i.e. a node NB) of the first capacitor C1 may be the second reference voltage Vref2, so as to remove the charges remained in the first capacitor C1.

On the other hand, since the first transistor is in a turn-on state, the first terminal (i.e. a node NC) of the second transistor M2 may receive the system high voltage OVDD, such that a voltage value on the node NC is a voltage value of the system high voltage VODD. Since the third transistor M3 and the tenth transistor M10 are all in the turn-on state, a voltage value on a node ND may be discharged to the first reference voltage Vref1. In other words, a voltage difference between the first reference voltage Vref1 and the system low voltage OVSS may be smaller than the lighting threshold voltage of the light emitting element, so that the light emitting element does not emit light in this phase.

When the pixel circuit 100 is operated in the voltage compensation period Tc, the first scan signal S1 and the second scan signal S2 may be maintained to an enabling state (for example, to have the low voltage level), such that the second to the fifth transistors M2-M5 are continuously turned on, and the source driving signal SD and the emission signal EM are disabled (for example, to have the high voltage level), such that the first transistor M1, the sixth transistor M6 and the tenth transistor M10 may be turned off, and the data voltage Vdata still cannot be transmitted to the pixel circuit 100.

In this case, the voltage value on the nodes NA, NB may still be the voltage value of the second reference voltage Vref2, and data state stored in the first capacitor C1 may be continually reset. Moreover, since the first transistor M1 is in a turn-off state, the node NC cannot receive the system high voltage OVDD, so that the voltage value on the node NC may be discharged from the original voltage value of the system high voltage OVDD (i.e. the voltage value on the node NC when the pixel circuit 100 is operated in the voltage reset period Tr) to a voltage value of a sum of the second reference voltage Vref2 and the threshold voltage of the second transistor M2.

In this way, the second capacitor C2 may store the threshold voltage of the second transistor M2. In other words, when the pixel circuit 100 is operated in the voltage compensation period Tc, the pixel circuit 100 may compensate the threshold voltage. Besides, since the tenth transistor M10 is also in the turn-off state, the voltage value on the node ND may be maintained to the voltage value of the first reference voltage Vref1, and the light emitting element LED is continually turned off and cannot be lighted.

On the other hand, when the pixel circuit 100 is operated in the data writing period Td, the first scan signal S1 and the source driving signal SD may be enabled (for example, to have the low voltage level), such that the second transistor M2, the fifth transistor M5 and the sixth transistor M6 are turned on, and the data voltage Vdata is transmitted to the pixel circuit 100. The second scan signal S2 and the emission signal EM may be disabled (for example, to have the high voltage level), such that the first transistor M1, the third to the fourth transistors M3, M4 and the tenth transistor M10 are turned off, and the node NA may receive the data voltage Vdata.

In this case, the voltage value on the node NA may be the voltage value of the data voltage Vdata, and the voltage value on the node NB may be still the voltage value of the second reference voltage Vref2. It should be noted that since the first transistor M1 is in the turn-off state, the node NC cannot receive the system high voltage OVDD, such that the voltage value on the node NC may be adjusted from the original voltage value of a sum of the second reference voltage Vref2 and the threshold voltage of the second transistor M2 to the voltage value of a sum of the data voltage Vdata and the threshold voltage of the second transistor M2. Therefore, the second capacitor C2 still stores the threshold voltage of the second transistor M2.

To be specific, when the pixel circuit 100 is operated in the data writing period Td, the pixel circuit 100 may enable the source driving signal SD (for example, to have the low voltage level) to turn on the six transistor M6, such that the data voltage Vdata may be written into the pixel circuit 100, and use the first capacitor C1 to store a voltage difference between the data voltage Vdata and the second reference voltage Vref2. Besides, since the tenth transistor M10 is in the turn-off state, the voltage value on the node ND is continually maintained to the voltage value of the first reference voltage Vref1, such that the light emitting element LED is still turned off and cannot emit light.

In a conventional pixel circuit, the threshold voltage compensation and data writing are generally performed in a same period, though the higher the resolution of the display panel is, the shorter a data writing time allocated to each pixel row is, and the shorter a time for the threshold voltage compensation is, such that the effect that the pixel compensation circuit compensates the threshold voltage is decreased, and the display panel still have the problem of uneven brightness.

It should be noted that the voltage compensation period Tc and the data writing period Td of the pixel circuit 100 are not overlapped with each other, so that a time length of the voltage compensation period Tc is not limited by a time length of the data writing period Td, i.e. the time length of the voltage compensation period Tc is not limited by the resolution of the display panel, and a designer may freely adjust the time length of the voltage compensation period Tc, such that regardless whether the pixel circuit 100 is applied to a low resolution or a high resolution display panel, an optimal threshold voltage compensation effect may be implemented, so as to maintain brightness evenness of the display panel.

On the other hand, when the pixel circuit 100 is operated in the emission period Te, the first scan signal S1, the second scan signal S2 and the source driving signal SD may be disabled (for example, to have the high voltage level), such that the third to the sixth transistors M3-M6 may be turned off, and the data voltage Vdata cannot be transmitted to the pixel circuit 100, and the nodes NA, NB are all in a floating state. Moreover, the emission signal EM may be enabled (for example, to have the low voltage level), such that the first to the second transistors M1-M2 and the tenth transistor M10 may be turned on.

To be specific, when the pixel circuit 100 is operated in the emission period Te, since the first to the second transistors M1-M2 and the tenth transistor M10 are all in the turn-on state, a conduction path may be formed between the system high voltage OVDD and the system low voltage OVSS. Moreover, a conduction degree of the second transistor M2 is related to a sum of cross voltages of the first to the second capacitors C1 to C2, a conduction current $I_d$ flowing through the light emitting element LED is related to the data voltage Vdata and the second reference voltage Vref2, and the light emitting element LED is lighted corresponding to the data voltage Vdata.

According to the above description, when the pixel circuit 100 of the present embodiment is operated in the voltage reset period Tr and the voltage compensation period Tc, the voltage setting circuit 110 may remove charges of the first capacitor C1 and reset the same according to the first scan signal S1 and the second scan signal S2, where when the pixel circuit 100 is operated in the voltage compensation period Tc, the pixel circuit 100 may further use the second capacitor C2 to store the threshold voltage in the second transistor M2, so as to compensate the threshold voltage. Besides, when the pixel circuit 100 is operated in the data writing period Td, the voltage setting circuit 110 may write the data voltage Vdata to the first capacitor C1 according to the source driving signal SD, such that the first capacitor C1 may store a voltage difference of the data voltage Vdata and the second reference voltage Vref2. In this way, the time length for the pixel circuit 100 of the present embodiment compensating the threshold voltage is not influenced by a time length for writing data to the first capacitor C1, so as to improve the quality of the display image presented by the display panel (not shown).

Figure 3:
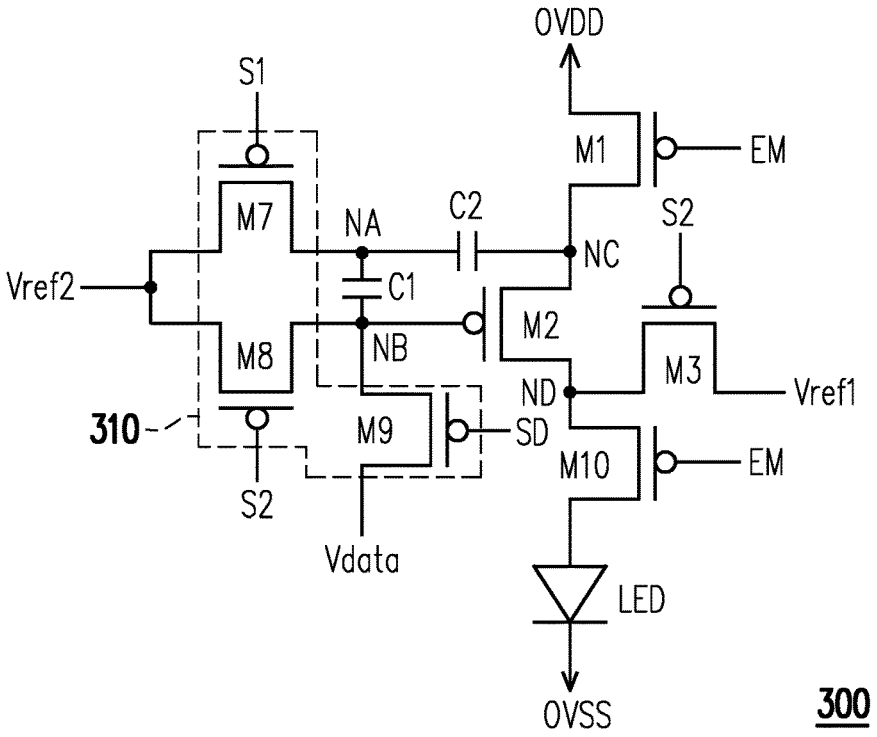
FIG. 3 is a circuit diagram of a pixel circuit according to another embodiment of the invention.

FIG. 3 is a circuit diagram of a pixel circuit 300 according to another embodiment of the invention. Referring to FIG. 1 and FIG. 3, the pixel circuit 300 is substantially the same to the pixel circuit 100, and a difference there between lies in the voltage setting circuit 310, where the same or similar components are denoted by the same or similar referential numbers. In the present embodiment, the voltage setting circuit 310 may include a seventh to a ninth transistors M7-M9, and the seventh to the ninth transistors M7-M9 of the present embodiment are, for example, also P-type transistors, though the invention is not limited thereto.

In the voltage setting circuit 310 of the present embodiment, a source (corresponding to a first terminal) of the seventh transistor M7 receives the second reference voltage Vref2, a gate (corresponding to a control terminal) of the seventh transistor M7 receives the first scan signal S1, and a drain (corresponding to a second terminal) of the seventh transistor M7 is coupled to the first end of the first capacitor C1. A source (corresponding to a first terminal) of the eighth transistor M8 receives the second reference voltage Vref2, a gate (corresponding to a control terminal) of the eighth transistor M8 receives the second scan signal S2, and a drain (corresponding to a second terminal) of the eighth transistor M8 is coupled to the second end of the first capacitor C1. A source (corresponding to a first terminal) of the ninth transistor M9 is coupled to the second end of the first capacitor C1, a gate (corresponding to a control terminal) of the ninth transistor M9 receives the source driving signal SD, and a drain (corresponding to a second terminal) of the ninth transistor M9 receives the data voltage Vdata.

Referring to FIG. 2 and FIG. 3, a function of the ninth transistor M9 of the present embodiment is similar to that of the sixth transistor M6 of the pixel circuit 100, i.e. the ninth transistor M9 is also used for determining whether the data voltage Vdata may be transmitted to the pixel circuit 300, such that the first capacitor C1 may store the voltage difference between the second reference voltage Vref2 and the data voltage Vdata. Moreover, in the present embodiment, related operation relationship of the pixel circuit 300 operated in the voltage reset period Tr, the voltage compensation period Tc, the data writing period Td and the emission period Te may refer to the operation relationship of the pixel circuit 100 operated in the voltage reset period Tr, the voltage compensation period Tc, the data writing period Td and the emission period Te, and detail thereof is not repeated.

Figure 4:
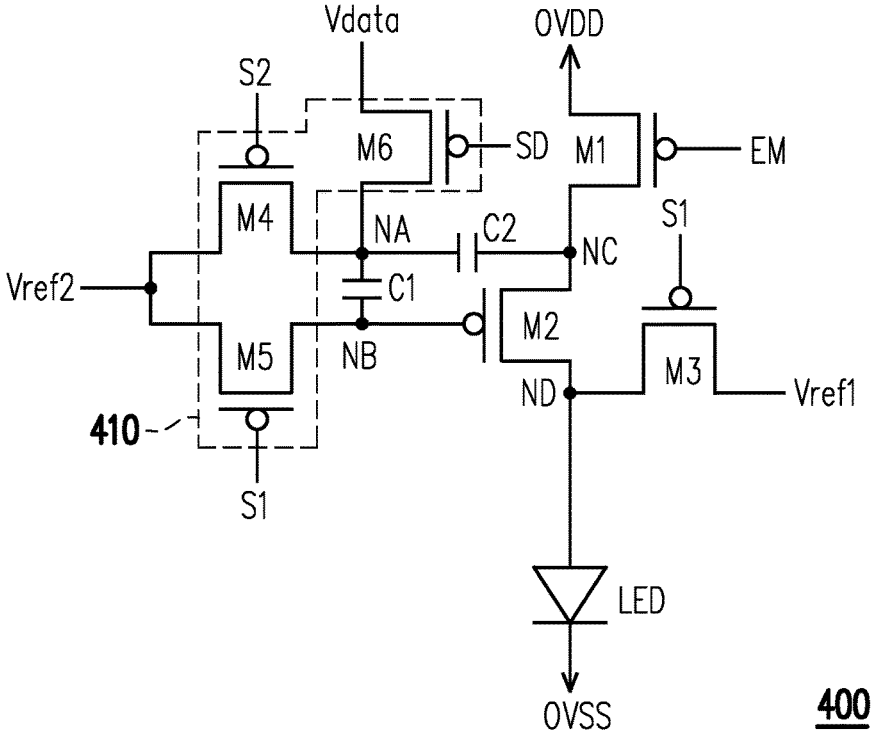
FIG. 4 is a circuit diagram of a pixel circuit according to still another embodiment of the invention.

FIG. 4 is a circuit diagram of a pixel circuit 400 according to still another embodiment of the invention. Referring to FIG. 1 and FIG. 4, the pixel circuit 400 is substantially the same to the pixel circuit 100, and a difference there between is that the pixel circuit 400 omits the tenth transistor M10, where the same or similar components are denoted by the same or similar referential numbers. Related operation relationship of the pixel circuit 400 operated in the voltage reset period Tr, the voltage compensation period Tc, the data writing period Td and the emission period Te may refer to the operation relationship of the pixel circuit 100 operated in the voltage reset period Tr, the voltage compensation period Tc, the data writing period Td and the emission period Te, and detail thereof is not repeated. Now, regardless whether a carrier mobility of the second transistor M2 is high or low, since the node NC is correspondingly varied, a light emitting degree of the light emitting element LED may be automatically balanced. It should be noted that in the embodiments of FIG. 1 and FIG. 3, since the pixel circuit 100 and the pixel circuit 300 all have the tenth transistor M10, in this case, the control terminal of the third transistor M3 may be coupled to the first scan signal S1 or the second scan signal S2. For example, if the control terminal of the third transistor M3 is coupled to the first scan signal S1, after the data writing operation, the voltage on the node NC of each of the pixels may be correspondingly adjusted in response to different carrier mobility of the second transistor M2 of different pixels. On the other hand, if the control terminal of the third transistor M3 is coupled to the second scan signal S2, after the data writing operation, the voltage on the node NC is not correspondingly adjusted in response to different carrier mobility of the second transistor M2 of different pixels. Therefore, different to the situation of the embodiments of FIG. 1 and FIG. 3 that the control terminals of the third transistors M3 are all coupled to the second scan signal S2, in the embodiment of FIG. 4, the control terminal of the third transistor M3 may be coupled to the first scan signal S1.

Figure 5:
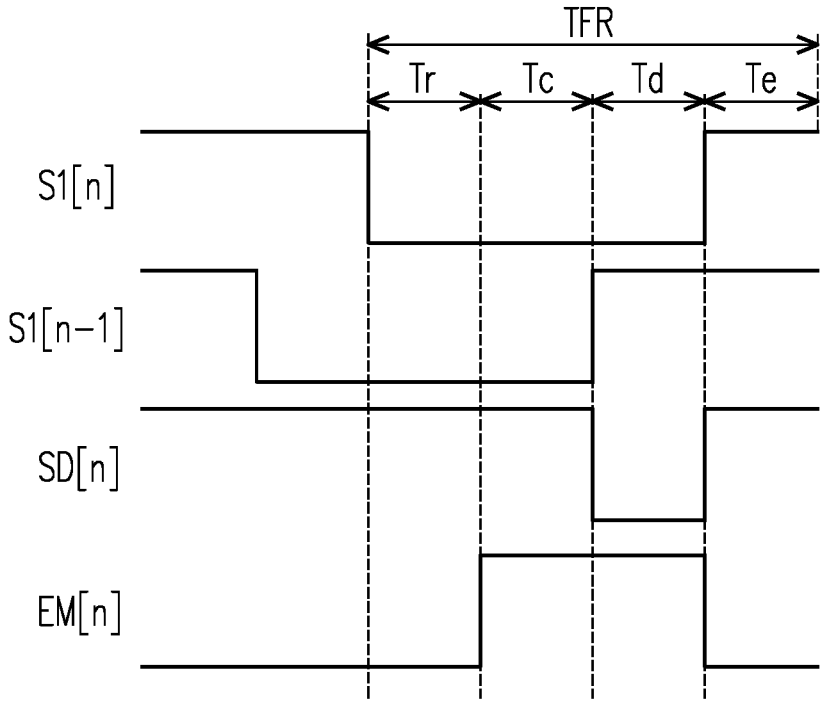
FIG. 5 is another waveform diagram of a pixel circuit according to an embodiment of the invention.

FIG. 5 is another waveform diagram of the pixel circuit 100 according to an embodiment of the invention. Referring to FIG. 1 and FIG. 5, in the present embodiment, one frame period TFR of the pixel circuit 100 may also be divided into the voltage reset period Tr, the voltage compensation period Tc, the data writing period Td and the emission period Te, and the voltage reset period Tr, the voltage compensation period Tc, the data writing period Td and the emission period Te are not overlapped with each other. A difference with the embodiment of FIG. 2 is that the second scan signal S2 is not used. In detail, the pixel circuit 100 of the present embodiment may be disposed in a pixel row (not shown) of a display panel (not shown), and the second scan signal S2 may be a previous first scan signal S1[n−1] provided to a previous pixel row (not shown), where n is a index. In this way, the pixel circuit 100 of the present embodiment is only required to control conduction states of the first to the fifth transistors M1-M5 in the pixel circuit 100 through the first scan signal S1, so as to reduce the number of required scan lines.

In summary, when the pixel circuit of the invention is operated in the voltage reset period and the voltage compensation period, the voltage setting circuit in the pixel circuit may remove charges stored in the first capacitor according to the first scan signal and the second scan signal, and when the pixel circuit is operated in the data writing period, the voltage setting circuit may write the data voltage to the first capacitor according to the source driving signal. In this way, a time length for the pixel circuit compensating the threshold voltage is not influenced by a time length for writing data to the first capacitor, so as to improve the quality of the display image presented by the display panel.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A pixel circuit, comprising:

a light emitting element, having an anode and a cathode receiving a system low voltage;

a first transistor, having a first terminal receiving a system high voltage, a control terminal receiving an emission signal and a second terminal;

a second transistor, having a first terminal coupled to the second terminal of the first transistor, a control terminal and a second terminal coupled to the anode of the light emitting element;

a first capacitor, having a first end and a second end coupled to the control terminal of the second transistor;

a second capacitor, having a first end coupled to the first end of the first capacitor and a second end coupled to the second terminal of the first transistor;

a voltage setting circuit, coupled to the first end and the second end of the first capacitor, and receiving a first scan signal, a second scan signal, a source driving signal and a data voltage and writing the data voltage to the first capacitor according to the source driving signal; and a third transistor, having a first terminal coupled to the second terminal of the second transistor, a control terminal coupled to the first scan signal and a second terminal receiving a first reference voltage, wherein the first reference voltage is smaller than a sum of the system low voltage and a lighting threshold voltage of the light emitting element.

2. The pixel circuit as claimed in claim 1, wherein the voltage setting circuit comprises:

a fourth transistor, having a first terminal receiving a second reference voltage, a control terminal receiving the second scan signal, and a second terminal coupled to the first terminal of the first capacitor;

a fifth transistor, having a first terminal receiving the second reference voltage, a control terminal receiving the first scan signal, and a second terminal coupled to the second terminal of the first capacitor; and a sixth transistor, having a first terminal receiving the data voltage, a control terminal receiving the source driving signal, and a second terminal coupled to the first terminal of the first capacitor.

3. The pixel circuit as claimed in claim 2, wherein the second reference voltage is greater than the first reference voltage.

4. The pixel circuit as claimed in claim 1, wherein the voltage setting circuit comprises:

a seventh transistor, having a first terminal receiving a second reference voltage, a control terminal receiving the first scan signal, and a second terminal coupled to the first terminal of the first capacitor;

an eighth transistor, having a first terminal receiving the second reference voltage, a control terminal receiving the second scan signal, and a second terminal coupled to the second terminal of the first capacitor;

a ninth transistor, having a first terminal coupled to the second terminal of the first capacitor, a control terminal receiving the source driving signal, and a second terminal receiving the data voltage.

5. The pixel circuit as claimed in claim 1, further comprising:

a tenth transistor, having a first terminal coupled to the second terminal of the second transistor, a control terminal receiving the emission signal, and a second terminal coupled to the anode of the light emitting element.

6. The pixel circuit as claimed in claim 1, wherein the pixel circuit is configured in a pixel row, and the second scan signal is a previous first scan signal provided to a previous pixel row.

7. The pixel circuit as claimed in claim 1, wherein a frame period used for driving the pixel circuit comprises a voltage reset period, a voltage compensation period, a data writing period and an emission period.

8. The pixel circuit as claimed in claim 7, wherein the voltage compensation period is later than the voltage reset period, the data writing period is later than the voltage compensation period, and the emission period is later than the data writing period.

9. The pixel circuit as claimed in claim 7, wherein the first scan signal is enabled in the voltage reset period, the voltage compensation period and the data writing period, the second scan signal is enabled in the voltage reset period and the voltage compensation period, the source driving signal is enabled in the voltage compensation period, and the emission signal is enabled in the voltage reset period and the emission period.

10. The pixel circuit as claimed in claim 7, wherein a time length of the voltage compensation period corresponds to a resolution of a display panel.

11. The pixel circuit as claimed in claim 1, wherein the light emitting element comprises one of an organic light emitting diode and a micro light emitting diode.

12. A pixel circuit, comprising:

a light emitting element, having an anode and a cathode receiving a system low voltage;

a first transistor, having a first terminal receiving a system high voltage, a control terminal receiving an emission signal and a second terminal;

a second transistor, having a first terminal coupled to the second terminal of the first transistor, a control terminal and a second terminal coupled to the anode of the light emitting element;

a first capacitor, having a first end and a second end coupled to the control terminal of the second transistor;

a second capacitor, having a first end coupled to the first end of the first capacitor and a second end coupled to the second terminal of the first transistor;

a voltage setting circuit, coupled to the first end and the second end of the first capacitor, and receiving a first scan signal, a second scan signal, a source driving signal and a data voltage and writing the data voltage to the first capacitor according to the source driving signal; and a third transistor, having a first terminal coupled to the second terminal of the second transistor, a control terminal coupled to the first scan signal and a second terminal receiving a first reference voltage, wherein the first reference voltage is delivered to the second terminal of the second transistor by the third transistor that is in a turn-on state.

* * * * *